US006935515B1

(12) United States Patent
Sookoo

(10) Patent No.: US 6,935,515 B1
(45) Date of Patent: Aug. 30, 2005

(54) TOOTHBRUSH ORGANIZER

(76) Inventor: Darrin S. Sookoo, 102 McKinley St., Brentwood, NY (US) 11717

( * ) Notice: Subject to any disclaimer, the term of this patent is extended or adjusted under 35 U.S.C. 154(b) by 9 days.

(21) Appl. No.: 10/413,716

(22) Filed: Apr. 15, 2003

(51) Int. Cl.[7] ..... A47B 81/02
(52) U.S. Cl. ..... 211/65
(58) Field of Search ..... 211/65, 119.009; 220/736, 740; 248/110; 312/206; D6/534, D6/528, 530, 531, 524

(56) References Cited

U.S. PATENT DOCUMENTS 1,507,466 A * 9/1924 Collins ..... 206/209.1
1,584,261 A * 5/1926 Vuolo ..... 206/362.1
1,975,691 A * 10/1934 Hibbs ..... 211/65
2,038,941 A * 4/1936 Koch ..... 312/31
D154,689 S * 8/1949 Lundgren ..... D6/534
2,642,331 A * 6/1953 Sprinkle ..... 312/283
2,956,851 A * 10/1960 Merendino ..... 312/207
3,727,748 A * 4/1973 Brown ..... 206/362.1
3,867,096 A * 2/1975 Doucette ..... 422/99
3,881,868 A * 5/1975 Duke ..... 206/209.1
3,954,407 A * 5/1976 Andary et al. ..... 250/455.11
D241,200 S * 8/1976 Halsted et al. ..... D6/534
D278,778 S * 5/1985 Brown ..... D6/534
4,852,833 A * 8/1989 Lockwood ..... 248/110
4,927,011 A * 5/1990 Wilkinson ..... 206/217
4,973,847 A * 11/1990 Lackey et al. ..... 250/455.11
4,995,511 A * 2/1991 Evans ..... 206/362.1
5,507,414 A * 4/1996 Ong ..... 222/108
5,522,497 A * 6/1996 Stacy ..... 206/209.1
5,566,823 A * 10/1996 Summers ..... 206/209.1
5,566,842 A * 10/1996 Dennis ..... 211/87.01
5,769,245 A * 6/1998 Butler ..... 211/65
5,799,910 A * 9/1998 Dexter ..... 248/109
D418,706 S * 1/2000 Robishaw ..... D6/534
6,142,318 A * 11/2000 Tooma ..... 211/65
6,253,931 B1 * 7/2001 Starkey ..... 211/65
6,325,222 B1 * 12/2001 Avery et al. ..... 211/65

* cited by examiner

*Primary Examiner*—Jennifer E. Novosad

(57) ABSTRACT

Toothbrush organizers provide a holder to keep toothbrushes free from contamination. A circular base and top are connected by one or more supports. The top has toothbrush holders adapted to receive electric toothbrushes or manual toothbrushes, along with an optional toothpaste holder for holding toothpaste. Toothbrush receivers are present in the top of the base beneath the toothbrush holders for holding manual toothbrushes. A cover removably encloses the top via a flange that is inserted into a cover receiver. Section walls within the interior of the cover isolate the toothbrush heads from one another. A finger hole in the top of the cover facilitates its removal.

14 Claims, 2 Drawing Sheets

TOOTHBRUSH ORGANIZER

BACKGROUND OF THE INVENTION

1. Field of the Invention

The present invention relates to a toothbrush organizer for use in connection with dental hygiene. The toothbrush organizer has particular utility in connection with providing a holder to keep toothbrushes free from contamination.

2. Description of the Prior Art

Toothbrush organizers are desirable for providing a holder to keep toothbrushes free from contamination. Conventional toothbrush holders leave the bristles of the toothbrush unprotected, where they can become contaminated with hairspray, antiperspirants, air fresheners, surface cleaners, splashed soap and water, and other common bathroom contaminants. While many toothbrush holders have been developed to protect the bristles from these outside contaminants, these designs still leave the bristles vulnerable to cross contamination from other toothbrushes stored within the toothbrush holder. The presence of section walls within the cover of the toothbrush organizer isolates the toothbrush heads from one another, thereby making the toothbrushes more sanitary by further reducing opportunities for bristle contamination.

The use of toothpaste tube holders is known in the prior art. For example, U.S. Pat. No. 5,799,910 to Dexter discloses a toothpaste tube holder. However, the Dexter '910 patent does not have a top cover, and has further drawbacks of lacking section walls to isolate toothbrush heads.

U.S. Pat. No. 5,769,245 to Butler discloses a toothbrush holder that protects the bristles of a toothbrush from contaminants. However, the Butler '245 patent does not have a toothpaste holder, and additionally does not have section walls to isolate toothbrush heads.

Similarly, U.S. Pat. No. Des. 418,706 to Robishaw discloses a toothbrush holder that holds toothbrushes. However, the Robishaw '706 patent does not have a top cover, and cannot isolate toothbrush heads.

In addition, U.S. Pat. No. 6,253,931 to Starkey discloses an oral hygiene product storage system that holds toothbrushes, toothpaste, and a rinsing glass. However, the Starkey '931 patent does not have a base, and also does not have section walls to isolate toothbrush heads.

Furthermore, U.S. Pat. No. 4,995,511 to Evans discloses a toothbrush and toothpaste holder that stores toothbrushes. However, the Evans '511 patent does not have indentations in its base, and further lacks section walls to isolate toothbrush heads.

Lastly, U.S. Pat. No. 5,566,842 to Dennis discloses a holder for storing a toothpaste dispenser and toothbrushes that holds a toothpaste pump dispenser and toothbrushes. However, the Dennis '842 patent does not have a top cover, and has the additional deficiency of lacking section walls to isolate toothbrush heads.

While the above-described devices fulfill their respective, particular objectives and requirements, the aforementioned patents do not describe a toothbrush organizer that allows providing a holder to keep toothbrushes free from contamination. The above patents make no provision for section walls to isolate toothbrush heads. The Dexter '910 patent, the Robishaw '706 patent, and the Dennis '842 patent do not have a top cover. The Butler '245 patent does not have a toothpaste holder. The Starkey '931 patent lacks a base. The Evans '511 patent does not have indentations in its base.

Therefore, a need exists for a new and improved toothbrush organizer that can be used for providing a holder to keep toothbrushes free from contamination. In this regard, the present invention substantially fulfills this need. In this respect, the toothbrush organizer according to the present invention substantially departs from the conventional concepts and designs of the prior art, and in doing so provides an apparatus primarily developed for the purpose of providing a holder to keep toothbrushes free from contamination.

SUMMARY OF THE INVENTION

In view of the foregoing disadvantages inherent in the known types of toothpaste tube holders now present in the prior art, the present invention provides an improved toothbrush organizer, and overcomes the above-mentioned disadvantages and drawbacks of the prior art. As such, the general purpose of the present invention, which will be described subsequently in greater detail, is to provide a new and improved toothbrush organizer which has all the advantages of the prior art mentioned heretofore and many novel features that result in a toothbrush organizer which is not anticipated, rendered obvious, suggested, or even implied by the prior art, either alone or in any combination thereof.

To attain this, the present invention essentially comprises a support connecting the outer edge of the top surface of a base to the outer edge of the side of a top. There is a toothbrush holder in the form of a hole in the top. A cover with a plurality of section walls attached to its interior removably encloses the top.

There has thus been outlined, rather broadly, the more important features of the invention in order that the detailed description thereof that follows may be better understood and in order that the present contribution to the art may be better appreciated.

The invention may also include a finger hole in the form of a hole in the top of the cover. There may be a toothpaste holder in the form of a hole in the middle of the top. There may be a toothbrush receiver in the form of an indentation in the top surface of the base. The top and the base may be circular in shape. The base, the top, the support, the cover, and the section walls may be made of plastic, steel, aluminum, titanium, wood, or carbon fiber composite. There may be a cover receiver in the form of a groove in the outer edge of the opposing side of the top. There may be a flange attached to the bottom edge of the cover. The toothbrush holder may be adapted to receive a manual toothbrush. The toothbrush holder may be adapted to receive an electric toothbrush. The support may connect the middle of the top surface of the base to the middle of the side of the top. The bottom edge of the cover may be removably connected to the top. There may be a plurality of supports, a plurality of toothbrush holders, and a plurality of toothbrush receivers. The flange may be removably inserted into the cover receiver. The section walls may isolate the brush heads of toothbrushes inserted into the toothbrush holders. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toothbrush organizer that has all of the advantages of the prior art toothpaste tube holders and none of the disadvantages.

It is another object of the present invention to provide a new and improved toothbrush organizer that may be easily and efficiently manufactured and marketed.

An even further object of the present invention is to provide a new and improved toothbrush organizer that has a low cost of manufacture with regard to both materials and labor, and which accordingly is then susceptible of low prices of sale to the consuming public, thereby making such toothbrush organizer economically available to the buying public.

Still another object of the present invention is to provide a new toothbrush organizer that provides in the apparatuses and methods of the prior art some of the advantages thereof, while simultaneously overcoming some of the disadvantages normally associated therewith.

Even still another object of the present invention is to provide a toothbrush organizer for providing a holder to keep toothbrushes free from contamination. This allows the user to insert his or her finger into the finger hole to remove the cover.

Still yet another object of the present invention is to provide a toothbrush organizer for providing a holder to keep toothbrushes free from contamination. This makes it possible to isolate the brush heads of toothbrushes inserted into the toothbrush holders from external contaminants.

An additional object of the present invention is to provide a toothbrush organizer for providing a holder to keep toothbrushes free from contamination. This makes it possible to isolate the brush heads of toothbrushes inserted into the toothbrush holders from cross contamination from each other.

A further object of the present invention is to provide a toothbrush organizer for providing a holder to keep toothbrushes free from contamination. This allows the user to store both electric and manual toothbrushes within the toothbrush organizer.

A still further object of the present invention is to provide a toothbrush organizer for providing a holder to keep toothbrushes free from contamination. This allows the user to store toothpaste within the toothbrush organizer.

Lastly, it is an object of the present invention to provide a new and improved toothbrush organizer for providing a holder to keep toothbrushes free from contamination.

These together, with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
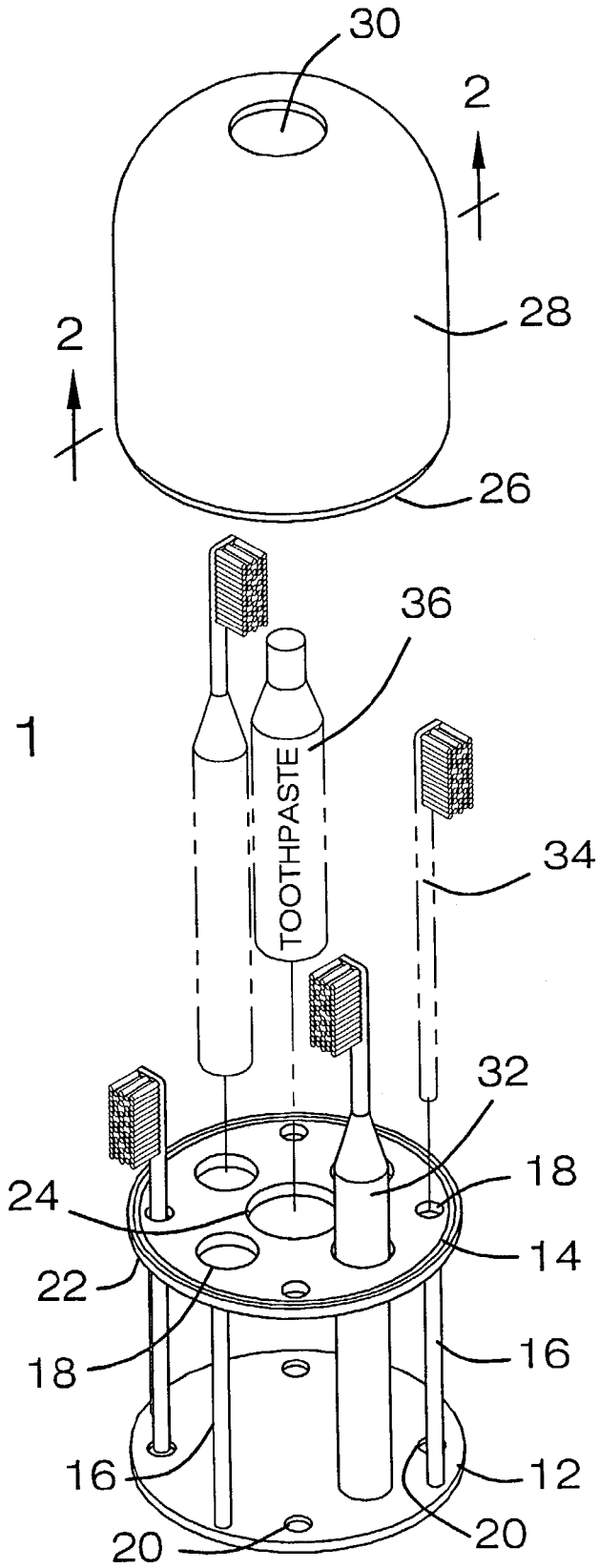
FIG. 1 is a top perspective view of the current embodiment of the toothbrush organizer constructed in accordance with the principles of the present invention.
Figure 3:
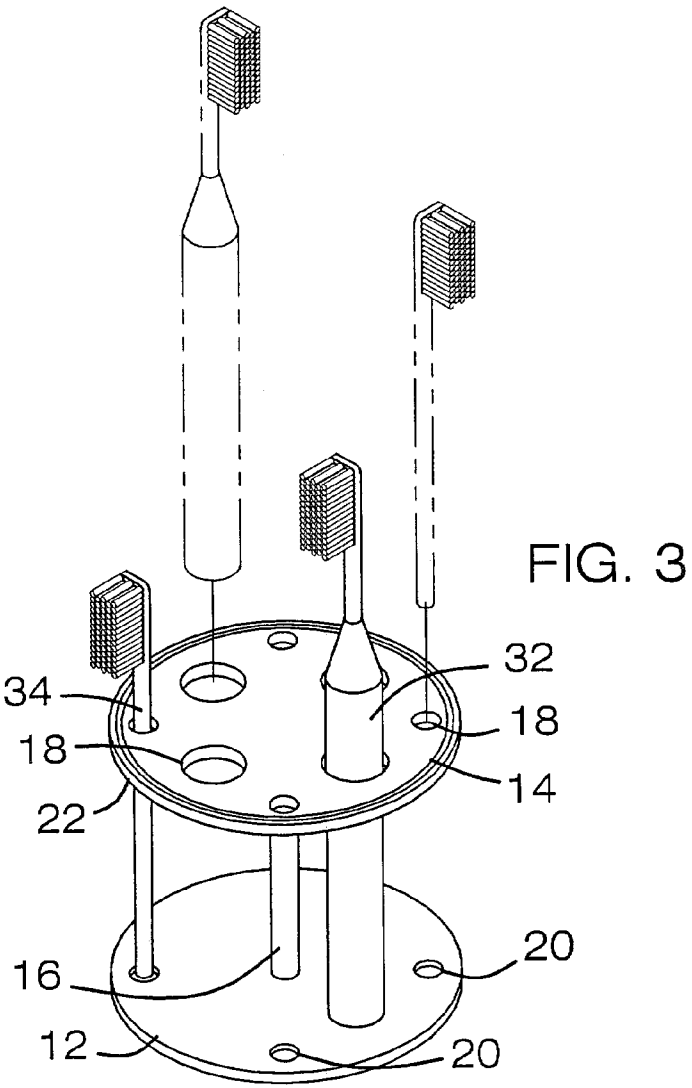
FIG. 3 is a top perspective view of an alternative embodiment of the support of the present invention.
Figure 2:
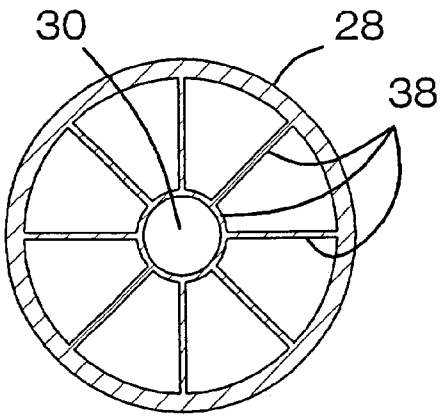
FIG. 2 is a top sectional view of the cover of the present invention.

Referring now to the drawings, and particularly to FIGS. 1–3, a current embodiment of the toothbrush organizer of the present invention is shown and generally designated by the reference numeral 10.

In FIG. 1, a new and improved toothbrush organizer 10 of the present invention for providing a holder to keep toothbrushes free from contamination is illustrated and will be described. More particularly, the toothbrush organizer 10 has a base 12 with toothbrush receivers 20 in the form of indentations in its top surface. Supports 16 connect the outer edge of base 12 to the outer edge of the underside of top 14. Top 14 has toothbrush holders 18 and a toothpaste holder 24 in the form of holes piercing its surface. The toothbrush holders 18 are formed in various sizes to hold either a manual toothbrush 34 or an electric toothbrush 32. The toothbrush receivers 20 hold a manual toothbrush 34 upright when it is inserted into the appropriately sized toothbrush holder 18. The toothbrush receivers 20 are arranged directly beneath the manual toothbrush 34-sized toothbrush holders 18. The toothpaste holder 24 is adapted to hold toothpaste 36. The outer edge of the top 14 has a groove cutting it to form a cover receiver 22. A flange 26 on the bottom of a cover 28 can be removably inserted into cover receiver 22 to enclose top 14. A finger hole 30 is present in the top of the cover 28 to facilitate the removal of cover 28 from the top 14. In the current embodiment, base 12 and top 14 are circular in shape. Base 12, top 14, supports 16, and cover 28 are made of plastic in the current embodiment. Note that the electric toothbrushes 32, manual toothbrushes 34, and toothpaste 36 are for illustrative purposes only and are not part of the current invention.

Moving on to FIG. 2, a new and improved cover 28 of the present invention for providing a holder to keep toothbrushes free from contamination is illustrated and will be described. More particularly, the cover 28 has a plurality of section walls 38 attached to its interior. The section walls 38 isolate the heads of the electric toothbrushes 32 and manual toothbrushes 34 inserted into toothbrush holders 18 from one another, thereby preventing cross contamination. The section walls 38 can be removed to facilitate cleaning. Finger hole 30 in the top of cover 28 is also visible. In the current embodiment, section walls 38 are made of plastic.

Concluding with FIG. 3, an alternative embodiment of the new and improved support 16 of the present invention for providing a holder to keep toothbrushes free from contamination is illustrated and will be described. More particularly, the support 16 connects the middle of the top surface of base 12 to the middle of the underside of top 14. In this embodiment, there is only a single support 16. Base 12 has toothbrush receivers 20 in its top surface. Toothbrush holders 18 in top 14 are adapted to hold either electric toothbrushes 32 or manual toothbrushes 34. A cover receiver 22 to receive the flange 26 (not shown) of cover 28 (not shown) is present on the outer edge of the top surface of the top 14. Note that the electric toothbrushes 32 and manual toothbrushes 34 are for illustrative purposes only and are not part of the current invention.

In use, it can now be understood that the user inserts the desired combination of electric toothbrushes 32 and manual toothbrushes 34 into toothbrush holders 18. Toothbrush receivers 20 are present below the toothbrush holders 18 adapted to fit manual toothbrushes 34. The toothbrush receivers 20 receive the ends of the manual toothbrushes 34, allowing the manual toothbrushes 34 to stand upright. If the toothbrush organizer 10 has a toothpaste holder 24 in its top 14, then the user can also store toothpaste 36 within the toothpaste holder 24. When the electric toothbrushes 32 and/or manual toothbrushes 34 are not in use, the flange 26 of cover 28 is inserted into cover receiver 22 so that cover 28 and section walls 38 protect the heads of the electric toothbrushes 32 and manual toothbrushes 34 from external contamination and cross contamination. When the user wishes to use an electric toothbrush 32 and/or a manual toothbrush 34, he or she inserts a finger into finger hole 30 of cover 28 and lifts to remove cover 28 from top 14. He or she then removes the appropriate electric toothbrush 32 and/or manual toothbrush 34 from the toothbrush holder 18, along with toothpaste 36 (if applicable) from toothpaste holder 24. After using the manual toothbrush 34 and/or electric toothbrush 32, the user replaces them into toothbrush holders 18, returns toothpaste 36 to toothpaste holder 24 (if applicable), and covers top 14 with cover 28.

While a current embodiment of the toothbrush organizer has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as steel, aluminum, titanium, wood, or carbon fiber composite may be used instead of the plastic base, top, supports, cover, and section walls described. And although providing a holder to keep toothbrushes free from contamination has been described, it should be appreciated that the toothbrush organizer herein described is also suitable for isolating a variety of small instruments from cross contamination and external contaminants. Furthermore, a wide variety of base and top shapes may be used instead of the circular shape described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothbrush organizer comprising:

a base having a top surface and an outer edge;

a support having opposing ends with one end connected to said outer edge of said base;

a top having an upper surface, a lower surface, a center, and an outer edge with said outer edge of said lower surface connected to said opposing end of said support;

a toothbrush holder wherein said top defines a hole therein to comprise said toothbrush holder;

a toothpaste holder wherein said center of said top defines a hole therein to comprise said toothpaste holder and said toothpaste holder is unobstructed when said lower surface of said top is connected to said support;

a cover having an interior, a top, and a bottom edge with said cover removably enclosing said top; and a plurality of section walls attached to said interior of said cover.

2. The toothbrush organizer as defined in claim 1, further comprising a finger hole wherein said top of said cover defines a hole therein to comprise said finger hole and said finger hole is unobstructed when said cover is frictionally engaged with and removably enclosing said top.

3. The toothbrush organizer as defined in claim 1, further comprising a toothbrush receiver wherein said top surface of said base defines an indentation therein to comprise said toothbrush receiver.

4. The toothbrush organizer as defined in claim 1, wherein said base and said top are circular in shape.

5. The toothbrush organizer as defined in claim 1, wherein said base, said top, said support, said cover, and said section walls are selected from the group consisting of plastic, steel, aluminum, titanium, wood, and carbon fiber composite.

6. The toothbrush organizer as defined in claim 1, further comprising a cover receiver wherein said outer edge of said upper surface of said top defines a groove therein to comprise said cover receiver.

7. The toothbrush organizer as defined in claim 6, further comprising a flange attached to said bottom edge of said cover.

8. A toothbrush organizer comprising:

a base having a top surface and a middle;

a support having opposing ends with one end connected to said middle of said base;

a top having an upper surface, a lower surface, a center, and an outer edge with said center of said lower surface connected to said opposing end of said support;

a toothbrush holder wherein said top defines a hole therein to comprise said toothbrush holder;

a cover having an interior, a top, a sidewall, and a bottom edge with said bottom edge removably connected to said top;

a finger hole wherein said top of said cover defines a hole therein to comprise said finger hole and said finger hole is unobstructed when said cover is frictionally engaged with and removably enclosing said top; and a plurality of section walls attached to said sidewall of said cover.

9. The toothbrush organizer as defined in claim 8, further comprising a toothbrush receiver wherein said top surface of said base defines an indentation therein to comprise said toothbrush receiver.

10. The toothbrush organizer as defined in claim 8, further comprising a cover receiver wherein said outer edge of said tipper surface of said top defines a groove therein to comprise said cover receiver.

11. The toothbrush organizer as defined in claim 10, further comprising a flange attached to said bottom edge of said cover.

12. A toothbrush organizer comprising:

a base having a top surface and an outer edge;

a plurality of supports having opposing ends with one end connected to said outer edge of said base;

a top having an upper surface, a lower surface, a center, and an outer edge with said outer edge of said lower surface connected to said opposing end of said supports;

a plurality of toothbrush holders wherein said top defines holes therein to comprise said toothbrush holders;

a toothpaste holder wherein said center of said top defines a hole therein to comprise said toothpaste holder and said toothpaste holder is unobstructed when said lower surface of said top is connected to said support;

a cover having an interior, a top, and a bottom edge with said cover removably enclosing said top;

a plurality of section walls attached to said interior of said cover;

a cover receiver wherein said outer edge of said upper surface of said top defines a groove therein to comprise said cover receiver;

a flange attached to said bottom edge of said cover removably inserted into said cover receiver; and a finger hole wherein said top of said cover defines a hole therein to comprise said finger hole and said finger hole is unobstructed when said flange is removably inserted into said cover receiver.

13. The toothbrush organizer as defined in claim 12, further comprising a plurality of toothbrush receivers wherein said top surface of said base defines indentations therein to comprise said toothbrush receivers.

14. The toothbrush organizer as defined in claim 12, wherein said section walls isolate the brush heads of toothbrushes inserted into said toothbrush holders.

* * * * *